US008640735B2

(12) United States Patent
Casalini et al.

(10) Patent No.: US 8,640,735 B2
(45) Date of Patent: Feb. 4, 2014

(54) WASTE WATER LIFTING INSTALLATION

(71) Applicant: Grundfos Holding A/S, Bjerringbro (DK)

(72) Inventors: Luca Casalini, Pontedera (IT); Alessandro Iacoponi, Pisa (IT); Ralf Schomäcker, Bielefeld (DE)

(73) Assignee: Grundfos Holding A/S, Bjerringbro (DK)

( * ) Notice: Subject to any disclaimer, the term of this patent is extended or adjusted under 35 U.S.C. 154(b) by 0 days.

(21) Appl. No.: 13/654,786

(22) Filed: Oct. 18, 2012

(65) Prior Publication Data

US 2013/0098482 A1 Apr. 25, 2013

(30) Foreign Application Priority Data

Oct. 19, 2011 (EP) ..... 11185758

(51) Int. Cl.
*E03D 1/00* (2006.01)

(52) U.S. Cl.
USPC ..... 137/565.17; 4/321; 417/423.3; 403/108

(58) Field of Classification Search
USPC ..... 137/565.17; 4/431, 321, 323; 417/360, 417/423.3, 36–41; 403/104, 106–108, 348
See application file for complete search history.

(56) References Cited

U.S. PATENT DOCUMENTS

| | | | | |
|---|---|---|---|---|
| 4,486,918 | A * | 12/1984 | Peebles | 16/422 |
| 5,632,586 | A * | 5/1997 | Nyholm | 411/552 |
| 6,837,645 | B2 * | 1/2005 | Kanatani et al. | 403/348 |
| 2004/0126183 | A1 * | 7/2004 | Steiner | 403/348 |
| 2006/0085900 | A1 | 4/2006 | Sigler et al. | |
| 2010/0122744 | A1 | 5/2010 | Mullen | |
| 2010/0319116 | A1 | 12/2010 | Schmidt et al. | |

FOREIGN PATENT DOCUMENTS

| | | | |
|---|---|---|---|
| DE | 24 04 685 | A1 | 8/1975 |
| EP | 1 035 262 | A2 | 9/2000 |
| EP | 1 679 407 | A1 | 7/2006 |
| FR | 2833979 | A1 * | 6/2003 |

* cited by examiner

*Primary Examiner* — John Rivell
*Assistant Examiner* — Angelisa Hicks
(74) *Attorney, Agent, or Firm* — McGlew and Tuttle, P.C.

(57) ABSTRACT

A waste water lifting installation has a collection container and a pump assembly. The pump assembly is fastened on a flange plate which closes an opening on the upper side of the collection container. The flange plate, on a first side edge which faces the middle region of the waste water lifting installation, is releasably fixed on the collection container with a single locking element.

20 Claims, 6 Drawing Sheets

WASTE WATER LIFTING INSTALLATION

CROSS REFERENCE TO RELATED APPLICATIONS

This application claims the benefit of priority under 35 U.S.C. §119 of European Patent Application 11185758.7 filed Oct. 19, 2011, the entire contents of which are incorporated herein by reference.

FIELD OF THE INVENTION

The invention relates to a waste water lifting installation with a collection container and with a pump assembly, wherein the pump assembly is fastened on a flange plate which closes an opening on an upper side of the collection container.

BACKGROUND OF THE INVENTION

Waste water lifting installations are applied, in order to lift or pump waste water which occurs below the level of a waste water conduit or a sewage system, to the level of a waste water conduit which is situated higher. This for example is the case with cellars or basement when discharges of sanitary objects are situated below the sewage system.

For this, waste water lifting installations are known, which comprise a collection container, into which the waste water to be lifted or delivered flows. A pump assembly, which then pumps the waste water from the collection container to a higher situated pump assembly, is arranged in or on the collection container. The switching on and off of the pump assembly is thereby effected in dependence on the water level in the collection container, i.e. the pump assembly is switched on when reaching a predefined maximal water level and is switched off again when reaching a predefined minimum water level.

Such waste water lifting installations are known, which may be connected directly to a WC (toilet) and then as a rule are set up behind the WC. With this set-up arises the problem that the waste water lifting installation is difficultly accessible for maintenance purposes. The pump assembly is usually fastened on a flange plate which closes an opening on the upper side of the collection container. For maintenance purposes, for example for cleaning, this flange plate and the pump assembly must be removed from the collection container and released. Several screws are to be released for this, wherein screws which in particular are situated in the middle region of the waste water lifting installation are very difficult to access with the arrangement behind a WC.

SUMMARY OF THE INVENTION

It is therefore the object of the invention, to provide a waste water lifting installation which is easier to open for maintenance purposes, even if the waste water lifting installation is placed where it is difficultly accessible, in particular directly behind a WC.

According to the invention, a waste water lifting installation is provided comprising a collection container with an opening on an upper side of the collection container and a flange plate which closes the opening of the collection container. A pump assembly is fastened on the flange plate. A single locking element releasably fixes the flange plate on the collection container at a first side edge which first side edge faces a middle region of the waste water lifting installation.

The waste water lifting installation according to the invention, as with known waste water lifting installations, comprises a collection container, into which waste water may flow through at least one run-in or a run-in opening. A pump assembly is arranged on or in the collection container and may pump waste water out of the collection container into an exit conduit and through this into a higher situated waste water conduit. Additionally, a level switch, for example in the form of a float switch, may be arranged in the collection container in the known manner, for switching the pump assembly on and off. The pump assembly is fastened on a flange plate which closes an opening on the upper side of the collection container. I.e. the flange plate is applied from above onto the opening on the upper side of the collection container and preferably is in sealed bearing contact with the edge of the opening of the collection container. For this, a seal may be arranged on the flange plate and/or on the edge of the opening on the collection container. The pump assembly is preferably designed such that an electrical drive motor is arranged above the flange plate, and a shaft extends from the electrical drive motor through an opening of the flange plate into the collection container. In the collection container, the shaft is connected to at least one pump impeller of a pump arranged there. Moreover, further components, in particular the previously described level switch, may be fastened on the flange plate. Preferably, the necessary electrical components, switches, connection terminals and control and regulation elements may preferably likewise be fastened on the upper side of the flange plate. Thus the flange plate with the pump assembly, a level switch and the electrical connection or control elements may form a sub-assembly (module) which in a preassembled manner may be inserted into the opening of the collection container, wherein the flange plate comes to bear on the edge of the opening.

The flange plate, on a first side edge which faces the middle region of the waste water lifting installation, according to the invention, is releasably fixed with a single locking element, on the collection container. The middle region of the waste water lifting installation is that region which is the most difficult to access, in particular if the waste water lifting installation is set up behind a WC. For this reason, it is advantageous if only a single locking element is arranged in this region and must be released for removing the flange plate. I.e. several poorly accessible screws on this side edge do not have to be released, but rather the flange plate may be easily released from the collection container by way of releasing a single locking element at this side edge.

The flange plate on a second side edge which is away from the first side edge is fastened on the collection container preferably by way of two screws. These may be conventional screws. The second side edge is preferably a side edge which is situated in the vicinity of the outer side of the waste water lifting installation or of the collection container and is easily accessible from the side even when setting up the waste water lifting installation behind or below a WC. Inasmuch as this is concerned, conventional screws may also be easily released and fastened again in this region. The first and the second side edge are thus arranged on two sides of the flange plate which are away from one another and preferably opposed. Thereby, the opening which is covered by the flange plate is preferably situated in one half of the waste water lifting installation, so that the first side edge is situated in the middle region of the waste water lifting installation and the second side edge is situated on a side of the waste water lifting installation, in particular on a narrow side of the waste water lifting installation. The run-in into the collection container, with this arrangement, is preferably located on a long side connecting the narrow sides of the waste water lifting installation, preferably essentially the middle of this long side. I.e. as a whole, the waste water lifting installation has an essentially rectangular shape seen from above.

If the first side edge is arranged essentially in the middle region of the waste water lifting installation, then the one locking element on this side edge is preferably also arranged in the middle region of the waste water lifting installation. As described, this as a rule is the most poorly accessible region of the waste water lifting installation, so that it is advantageous to only arrange a locking element there, which is easy to release.

The locking element is thereby preferably arranged adjacently to a central run-in of the collection container. As described, the run-in is preferably open to a longitudinal aside of the collection container which is essentially rectangular in a plan view. The run-in is thereby located essentially in the middle of this long side and thus in the middle region of the waste water lifting installation. The opening, on which the flange plate is arranged, thereby preferably lies laterally of the run-in, in one half of the collection container which is delimited by the run-in. The other half of the collection container is preferably closed by a housing part. With this arrangement of the flange plate in one half of the waste water lifting installation, the locking element is then situated preferably adjacent to the central run-in and is also easy to release in this poorly accessible position.

According to a preferred embodiment of the invention, the locking element is pivotably or rotatably mounted on the flange plate or the collection container. Thereby, the locking element is designed such that it is movable by way of rotating or pivoting between a locking position, in which the flange plate is fixed on the collection container by way of the locking element, and a released position, in which the flange plate on the first side edge is released from the collection container.

Thereby, the locking element is preferably rotatable between a locking position and a released position about an angle of smaller than 360° and preferably smaller or equal to 180°. I.e., a relatively small rotational movement or pivot movement is sufficient, in order to move the locking element between the locking position and the released position. The locking element may thus be released and locked much more easily than a conventional screw which needs to be rotated several times, i.e. a multiple of 360°.

For this reason, it is preferable for the locking element on its upper side to comprise a grip element which may be gripped with the fingers, by way of which the locking element may be moved, i.e. in particular rotated or pivoted. This allows the locking element to be moved simply by hand between the locking position and the released position without any special tool. Thus the release and locking is further simplified, since one does not need to additionally play around with tools, for example a screw driver, in the difficultly accessible region. Alternatively however, it is possible to provide the locking element with an engagement for a tool, in particular with a slot for receiving a screwdriver. Alternatively, an outer contour which can be gripped by a spanner, such as e.g. a hexagon, is also conceivable. Thereby, in particular, specially angled tools may be used, which may be applied onto the locking element and may be moved together with the locking element, even in a difficultly accessible region behind or below the WC.

The locking element, for engagement on the collection container, usefully comprises a first engagement element which may be brought into engagement with a corresponding second engagement element. Thereby, preferably the first engagement element is arranged on the flange plate, and the second engagement element on the collection container. In the locked position thereby, the first and the second engagement element are in engagement with one another, by which means the flange plate is fixed on the collection container. In the released position, the first engagement element is disengaged from the second engagement element, so that the flange plate in the region of the first side edge may be removed from the collection container. By way of movement of the locking element, the first engagement element may be brought into engagement with the second engagement element and be disengaged again from this. The movement is preferably a rotation or pivoting movement, as described above.

The first engagement element may be an engagement projection, and the second engagement element may be designed as a recess or undercut which may be brought into engagement with the engagement projection. Thus the engagement projection may be designed for example as pivotable bar which extends normally to the rotation or pivot axis of the locking element. Such a bar may engage into a pocket which forms the second locking element. Thereby, the bar in the locked position engages behind an edge or undercut of the second engagement element, such that the flange plate may be removed from the collection container. In the released position, the engagement projection is disengaged from the recess or pocket or the undercut, so that the flange plate may be removed with the first side edge from the collection container.

The second engagement element may preferably be formed on or in an insert which is connected, preferably screwed, to the collection container or the flange plate. Such an insert has the advantage that an undercut or pocket may be more easily formed in the collection container, since these elements do not need to be designed as one piece with the collection container, but may be formed by a separate component. The manufacture is therefore simplified. Moreover, the engagement element may be exchanged when damaged, as the case may be.

In a particular embodiment of the invention, the first and the second engagement element may comprise corresponding threads which may be brought into engagement with one another. Thereby, the threads preferably have such a pitch, that a small rotation of the locking element is already sufficient, in order to bring the thread of the first and second engagement into and out of engagement. In this case, the locking element with the thread is preferably provided with a hand grip, so that it may be easily manually locked and released.

According to a further preferred embodiment of the invention, the first engagement element may be designed as a pivotable lever and the second engagement element as a locking projection which is preferably formed on the flange plate, wherein in the locking position, the lever engages over the locking projection on its upper side. In the released position, the lever accordingly releases the locking projection, so that the locking projection may be removed with the flange plate upwards from the collection container. I.e. for locking, the lever is pivotable in the region above the locking projection and for release it may be moved out of this region above the locking projection. For this, the lever is fastened on the collection container in a pivotable manner.

Preferably, the lever is movable about a horizontally extending pivot axis. Moreover, the lever is preferably designed in a manner such that it is releasably fixed in the locking position with a non-positive fit and/or positive fit. For this, a locking element, for example a locking projection, may be provided on the collection container, with which projection the lever locks in the locking position, in order to prevent an unintended release of the lever. The locking element however is designed such that the locking connection may be released by way of the manual application of force onto the lever, and the lever is pivotable into the released position. Instead of a locking element, one may also provide a purely non-positive fit fixation by way of a clamping element.

Particularly preferably, the lever is curved in a manner such that in the locking position, it comes to bear on a curved outer surface of the run-in of the collection container. The run-in of the collection container is preferably shaped such that it curves by 90° from a vertically arranged run-in and runs out from above into the collection container. A correspondingly curved outer surface of the run-in is on the thus formed run-in, on which run-in the correspondingly curved lever may come to bear in the locking position. The lever thus takes up little space.

Particularly preferably, the flange plate and components arranged thereon are covered by a housing part, wherein the locking element and the housing part are shaped in a manner corresponding to one another, so that the housing part may not be attached on the flange plate when the locking element is located in the released position. I.e. the locking element is designed such that in the released position, it extends into a region which is taken up by a part of the housing part when the housing part is put on. Thus the placing of the housing part is blocked by the released locking element. For example, a pivotable lever in the released position may extend such that it abuts on a wall of the housing part, before the housing part is applied correctly onto the collection container. By way of this design, one succeeds in housing of the waste water lifting installation not being able to be closed before the flange plate is correctly fastened with the locking element on the collection container. The sealed bearing contact of the flange plate in the edge region of the opening is created in this manner and a faulty functioning and in particular leakages on account of an insufficient fastening of the flange plate are avoided.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 10:
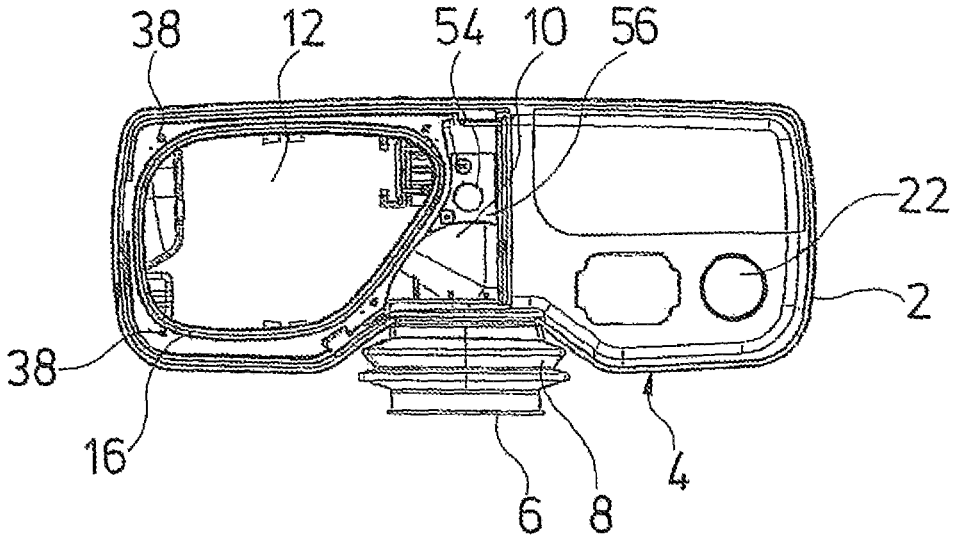
FIG. 10 is a plan view according to FIG. 9, with a removed flange plate.
Figure 11:
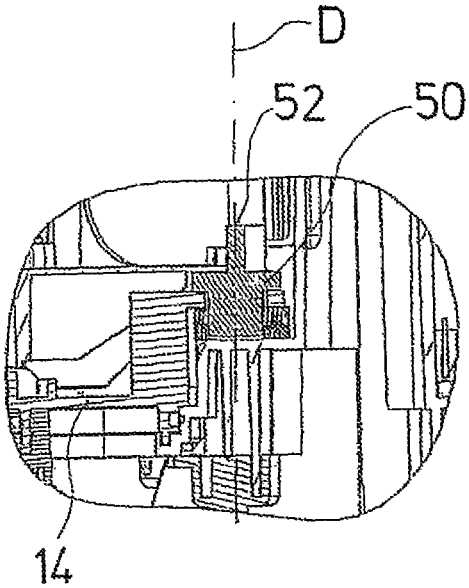
FIG. 11 is a detail enlargement of the cross section along line XI-XI in FIG. 9.

Common to all three described embodiments is the fact that the waste water lifting installation comprises a collection container 2. The collection container 2, seen from above, has an essentially rectangular basic shape. A run-in opening 6 is arranged centrally in the width direction on the front long side 4. The run-in opening 6 extends in a vertical plane and, departing from the front side 4, is directed to the front. The run-in 8 extends from the run-in opening 6 into the inside of the collection container 2. Thereby, the run-in 8 angles by 90° and is limited at the upper side by an arched wall 10. The part of the run-in 8 which faces the run-in opening 6 is designed as an elastic sealing sleeve for connection to a discharge pipe of a WC, so that the shown waste water lifting installation may be set up and connected on the rear side of a WC. The collection container 2 on its upper side, as is shown in FIG. 10, comprises an opening 12. This design is common to all shown embodiments. A flange plate 14 is applied onto the opening 12, so that the flange plate 14 comes to bear on the edge 16 of the opening 12 in a sealing manner. Thereby, a seal may be arranged on the edge 16 or on the flange plate 14. One may recognize in FIG. 10 that the opening 12 in the plan view is only located in one half of the collection container 2, wherein the middle is defined by the run-in opening 6 and the run-in 8. Here, the opening 12 is arranged on the left of the run-in 8. The collection container 2 is closed on the right.

Figure 12:
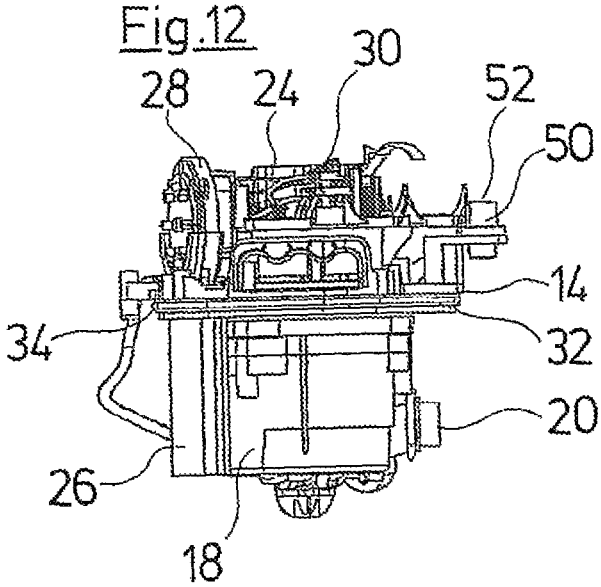
FIG. 12 is a side view of the flange plate removed from the waste water lifting installation, with assemblies arranged thereon.

All electrical assemblies which are required for the operation of the waste water lifting installation are arranged on the flange plate 14, as is to be recognized in particular in FIG. 12. Thereby, the arrangement of the assemblies, also with the other two embodiments, corresponds to the arrangement shown in FIG. 12. A pump 18 is arranged below the flange plate 14. The pump 18 delivers the waste water located in the collection container 2, via its exit opening 20 and a pressure conduit arranged in the collection container 2, to the exit 22. An exit conduit which leads into a waste water conduit situated higher may be connected onto the exit 22. An electric motor 24 which drives a pump 18 via a shaft extending through an opening in the flange plate 14 is arranged above the flange plate 14. Moreover, a level switch 26 which extends into the inside of the collection container 2 is arranged on the flange plate 14. The electrical switch element 28 of the level switch 26 is arranged above the flange plate 14. Moreover, electrical connection elements 30 are arranged above the flange plate 14, so that the flange plate 14 carries all electrically operated components of the waste water lifting installation and thus forms a module which may be completely inserted into the opening 12.

Hereinafter, three different systems are described for fastening the flange plate 14 on the collection container 2. The flange plate 14 with all these systems is releasably fastened with two opposed side edges on the collection container 2. Thereby, the first side edge 32 of the flange plate 14 in the middle region lies directly adjacent the run-in 8, whilst the second side edge 34 of the flange plate 14 lies opposed on the side, i.e. a narrow side of the collection container 2. The flange plate 14, on the second side edge 34, with all three embodiments, is fastened by way of two screws 36 which engage into holes 38 on the collection container 2. The holes 38 are arranged in the vicinity of the edge 16 of the opening 12. Since the second side edge 34 of the flange plate 14 is situated on the side edge of the collection container 2, this region is also easily accessible when the waste water lifting installation is set up behind or below a WC. Thus the screws 36 may be designed in a conventional manner and may be released with a conventional tool, in particular with a screwdriver.

The first side edge 32 however as a rule is difficultly accessible, so that here, according to the invention, a different fastening is envisaged. Here, one does without the normal standard screws. According to a first embodiment of the invention which is described in more detail by way of FIGS. 2-7, instead of this, a locking element 40 in the form of a pivotable bar 40 is provided. This locking element 40 is arranged on the flange plate 14. The pivotable bar 40 is designed as a radially projecting locking projection which extends radially outwards from a sleeve 42 rotatable about the pivot axis S. The upper side of the sleeve 42 is closed off by a slotted plug 44 which is connected to the sleeve 42 in a rotationally fixed manner. A spanner 46 for rotating the sleeve 42 may engage into the slot of the plug 44. Thereby, the spanner 46 is designed angled, so that it may be inserted and rotated even when little free space is available above the waste water lifting installation.

Figure 3:
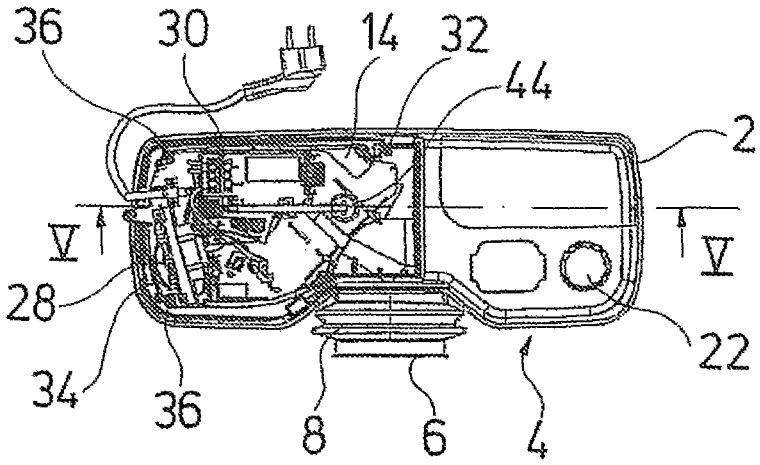
FIG. 3 is a plan view of the waste water lifting installation according to FIG. 2, in the locked condition.
Figure 4:
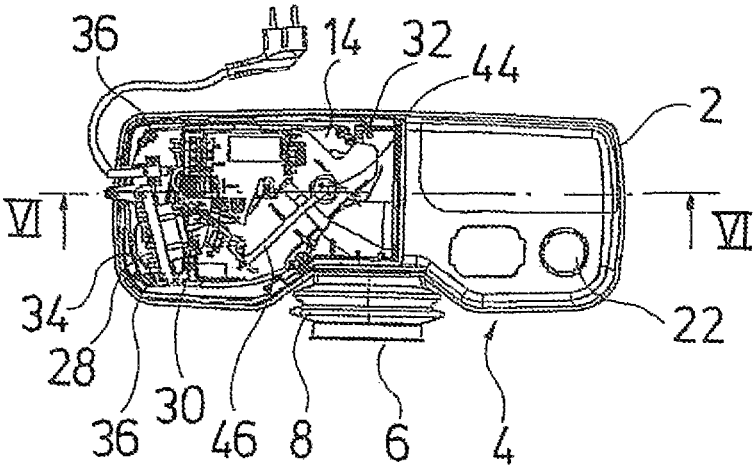
FIG. 4 is a plan view of the waste water lifting installation according to FIG. 2, in the unlocked condition.
Figure 5:
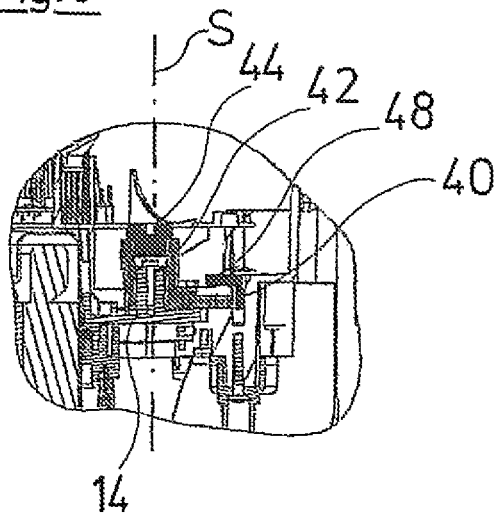
FIG. 5 is a detail enlargement of the cross section along line V-V in FIG. 3.
Figure 6:
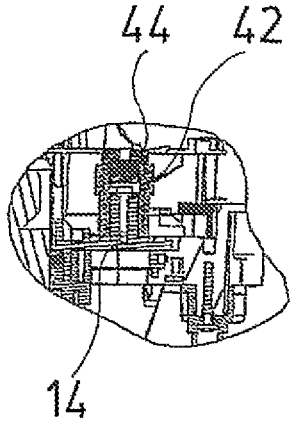
FIG. 6 is a detail enlargement of the cross section along line VI-VI in FIG. 4.
Figure 7:
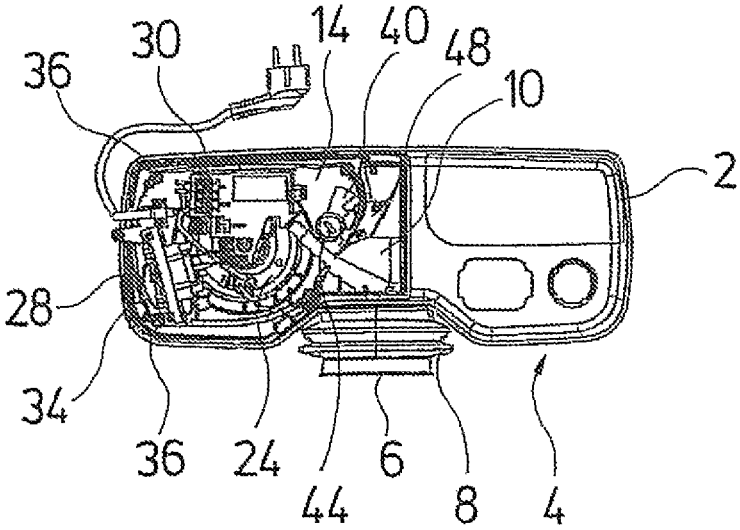
FIG. 7 is a plan view of the waste water lifting installation according to FIGS. 2-4, wherein the flange plate has been omitted in the representation.
Figure 8:
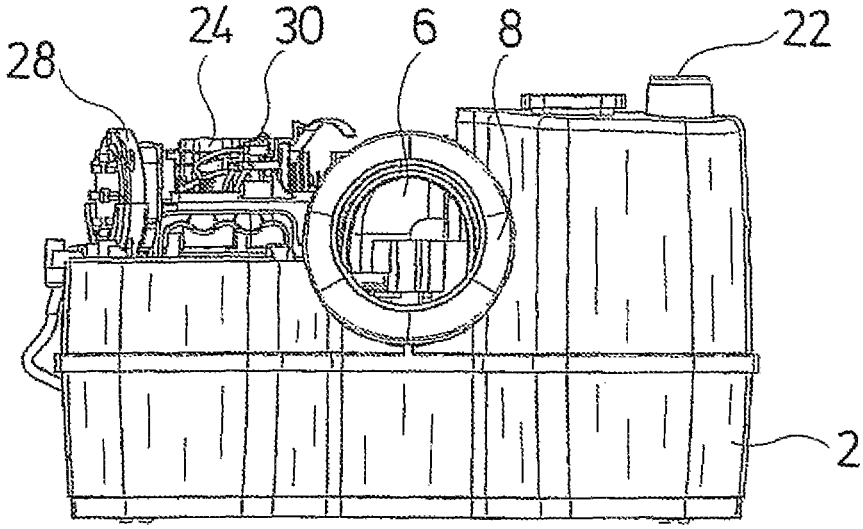
FIG. 8 is a front view of a waste water lifting installation according to a second embodiment of the invention, with a removed housing cover.
Figure 9:
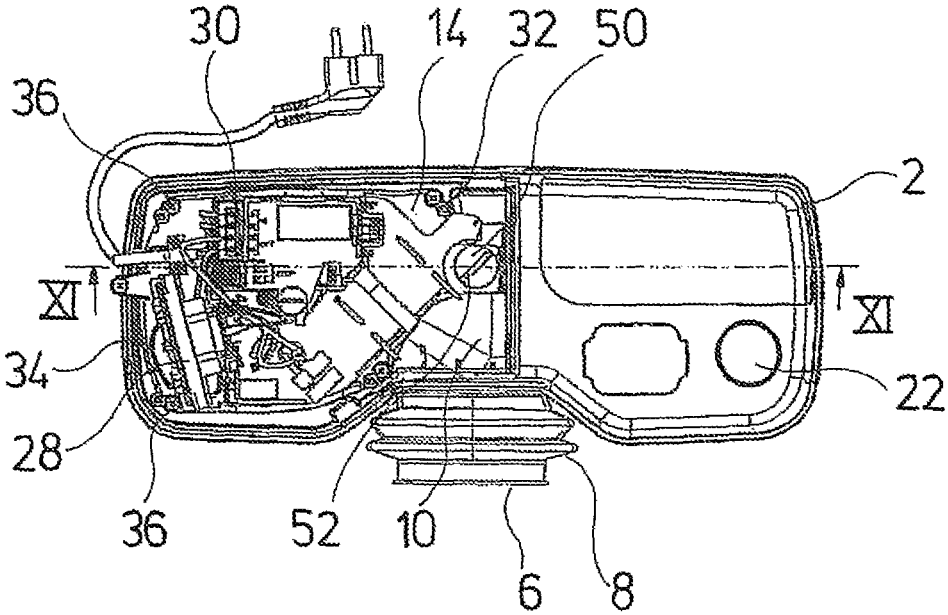
FIG. 9 is a plan view of the waste water lifting installation according to FIG. 8.

The bar 40 in the locking position moves below an abutment plate 48 which is fastened as an insert on the collection container 2 by way of two screws. The abutment plate 48 thus forms an undercut, under which the bar 40 engages in a locking position, so that the flange plate 14 may not be lifted upwards, since the bar 40 comes to bear on the lower side of the abutment plate 48. In the released position which is shown in FIGS. 6 and 7, the bar 40 lies next to the abutment plate 48, so that it may be moved upwards past this. In order to be moved from the locked position which is shown in FIGS. 3 and 5, into the released or unlocked position which is shown in FIGS. 4, 6 and 7, the sleeve 42 with the bar 40 needs only to be rotated about a small angle of about 45°, so that a very simple release and locking is possible, significantly more simple than with a conventional screw which needs to be rotated several times about its own axis.

A second example is shown in FIG. 8-12. There, the locking element is designed as a screw element 50 on the first side edge 32 of the flange plate 14 and is rotatably fastened on the flange plate 14. The screw element 50 on its upper side comprise a grip element 52, on which it may be easily gripped with the fingers or hand, so that it may be rotated about the rotation axis D without any tool. At its lower end, the screw element 50 has a thread, with which an opening 54 on the collection container 2 engages, wherein the opening 54 is provided with a corresponding thread. An individual large screw element 50 may be very much more simply gripped and actuated by the hand, than conventional small screws, as the screws 36, so that a simpler locking and unlocking between the flange plate 14 and the collection container 2 is achieved here on the first side edge 32. Preferably, the thread of the screw element 50 and the corresponding opening 54 also has a larger pitch with only a single or few thread flights, so that a smaller rotational angle or less rotations of the screw element 50 about the rotation axis D are sufficient, in order to lock or unlock the screw element 50 in the opening 54.

The opening 54 here is formed in an insert 56 which is screwed on the collection container 2 by way of two screws.

Figure 14:
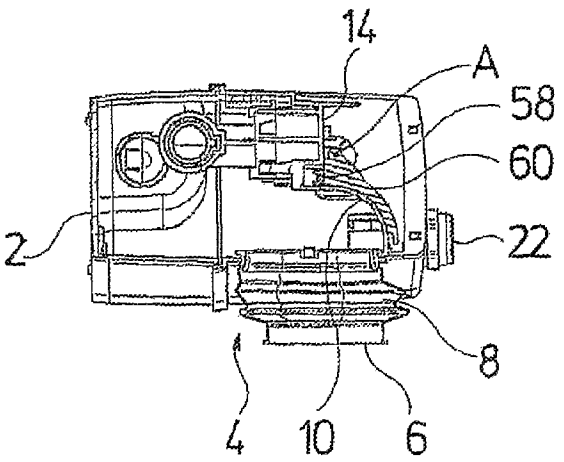
FIG. 14 is a sectioned view along line XIV-XIV in FIG. 13.
Figure 13:
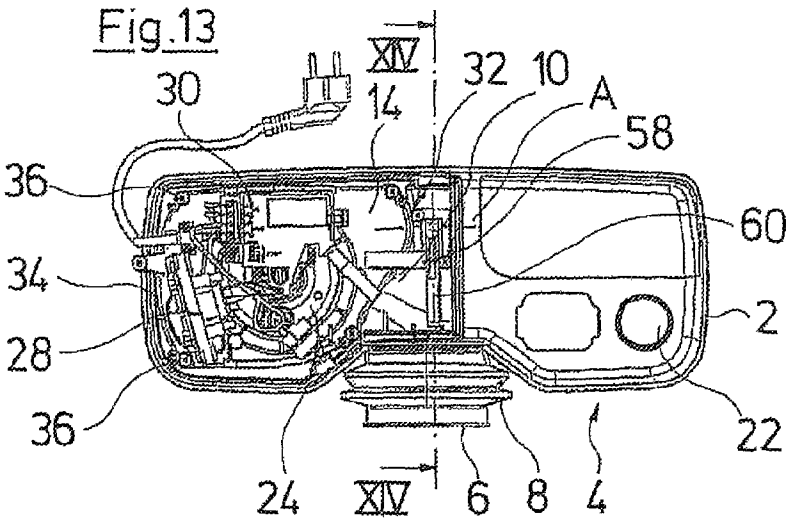
FIG. 13 is a plan view of a waste water lifting installation according to a third embodiment of the invention, with a removed housing cover.

A third embodiment of the invention is explained by way of FIGS. 13-16. In this embodiment, the flange plate 14 has a locking projection 58 which extends to the middle of the waste water lifting installation outwards past the first side edge 32 in the horizontal direction. A pivotable lever 60 is arranged on the collection container 2 and is pivotable about a horizontally extending pivot axis A. In the locked position, the lever 60 is pressed downwards and engages over the locking projection 58 at its upper side, so that the locking projection 58 with the flange plate 14 may not be moved upwards. In the unlocked position, the lever 60 is pivoted such that the space above the locking projection 58 is released and the locking projection 58 with the flange plate 14 may be removed to the top. The lever 60 is curved in a manner such that in the locked position, it bears or snugly lies on the outer side of the arch-shaped wall 10. Thereby, as is to be seen in FIG. 14, the lever 60 is so wide between the pivot axis A and the arch-shaped wall 10, that the lever 60 may only pass the arch-shaped wall 10 amid slight elastic deformation. Thus, a clamping or releasable fixation of the lever 60 in the locked position occurs, which is shown in FIGS. 13 and 14.

Figure 1:
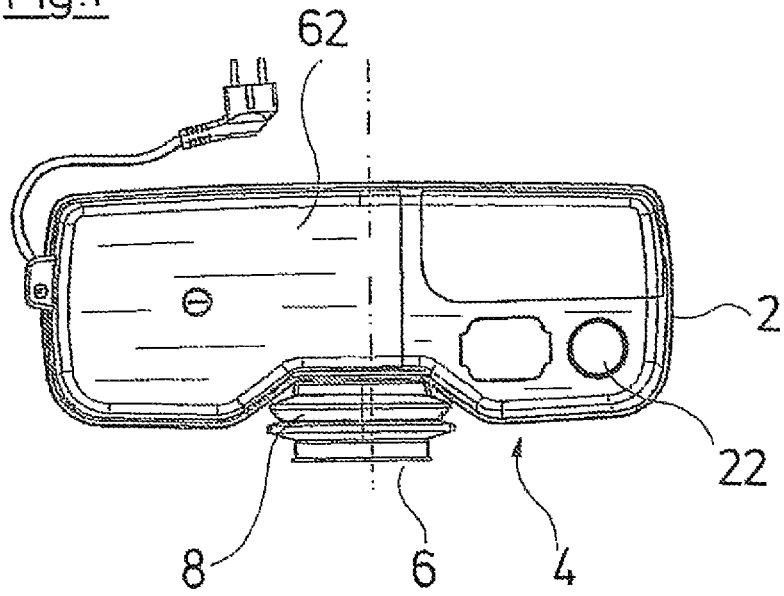
FIG. 1 is a plan view of the waste water lifting installation according to the invention.
Figure 2:
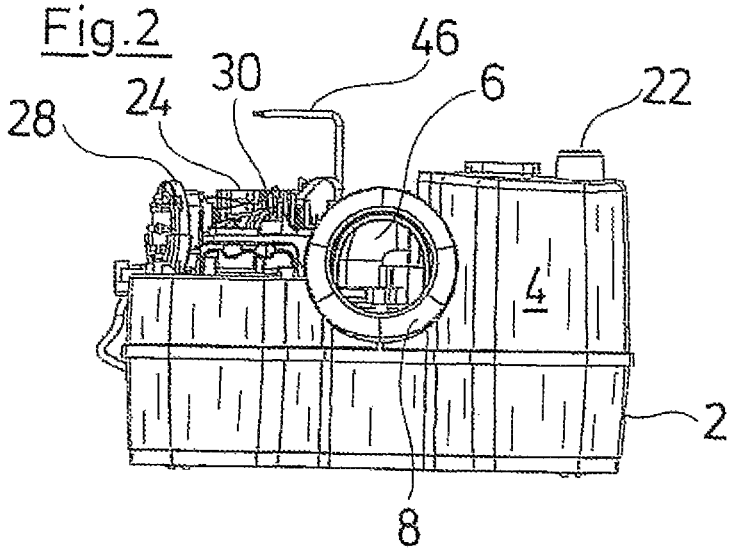
FIG. 2 is a front view of a waste water lifting installation according to a first embodiment of the invention, with a removed housing cover.
Figure 16:
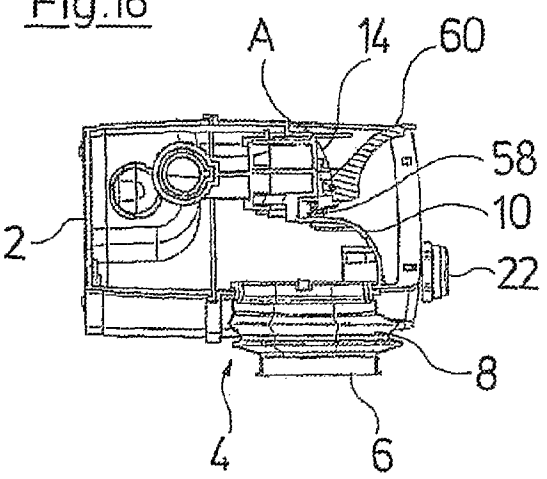
FIG. 16 is a section view along line XVI-XVI in FIG. 15.
Figure 15:
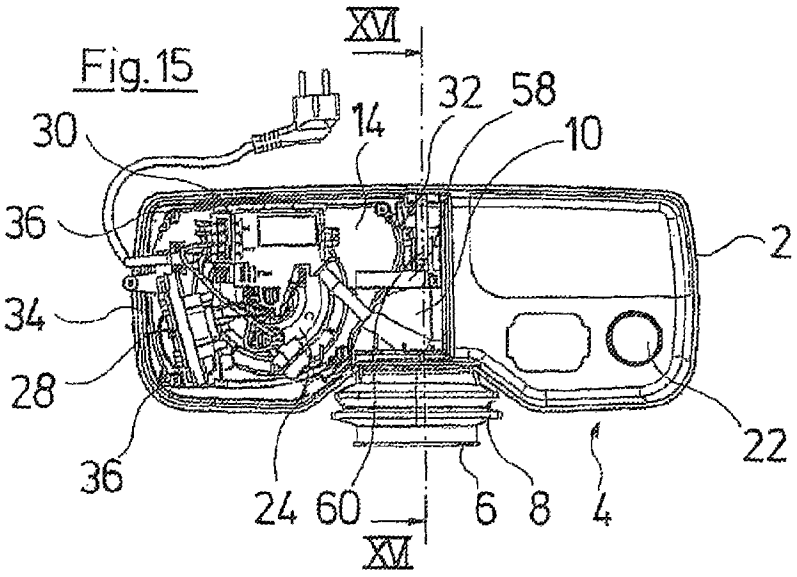
FIG. 15 is a plan view according to FIG. 13, in the unlocked condition.

If the lever 60 is located in the un-locked position which is shown in FIGS. 15 and 16, the lever 16 projects so far upwards, that a housing part or housing cover 62 (see FIG. 1) may not be fastened above the flange plate 14 and the components arranged above this. The lever 60 abuts on the inner side of the housing cover 62, before this is correctly applied onto the collection container 2. In this manner, one ensures that the housing cover 62 may only be put on when the lever 60 is located in the locked position.

While specific embodiments of the invention have been shown and described in detail to illustrate the application of the principles of the invention, it will be understood that the invention may be embodied otherwise without departing from such principles.

Appendix

List of Reference Numerals

| | |
|---|---|
| 2 | collection container |
| 4 | front side |
| 6 | run-in opening |
| 8 | run-in |
| 10 | arch-shaped wall |
| 12 | opening |
| 14 | flange plate |
| 16 | edge |
| 18 | pump |
| 20 | exit opening |
| 22 | exit |
| 24 | electric motor |
| 26 | level switch |
| 28 | electrical switch element |
| 30 | electric connection elements |
| 32 | first side edge |
| 34 | second side edge |
| 36 | screws |
| 38 | holes |
| 40 | bar |
| 42 | sleeve |
| 44 | plug |
| 46 | spanner |
| 48 | abutment plate |

-continued

| | |
|---|---|
| 50 | screw element |
| 52 | grip element |
| 54 | opening |
| 56 | insert |
| 58 | locking projection |
| 60 | lever |
| 62 | housing cover |
| S, A | pivot axes |
| D | rotation axis |

What is claimed is:

1. A waste water lifting installation comprising:

a collection container with an opening on an upper side of the collection container;

a flange plate which closes the opening of the collection container;

a pump assembly fastened on the flange plate; and a single locking element releasably fixing the flange plate on the collection container at a first side edge which first side edge faces a middle region of the waste water lifting installation, wherein the locking element is rotatable about an angle of smaller than 360° , between a locking position and a released position.

2. A waste water lifting installation according to claim 1, wherein the flange plate is fastened on the collection container on a second side edge by way of two screws, the second side edge being away from the first side edge.

3. A waste water lifting installation according to claim 1, wherein the single locking element is arranged in a middle region of the waste water lifting installation.

4. A waste water lifting installation according to claim 3, wherein the single locking element is arranged adjacent to a central run-in of the collection container.

5. A waste water lifting installation according claim 1, wherein the locking element is pivotably or rotatably mounted on the flange plate or on the collection container.

6. A waste water lifting installation according to claim 5, wherein the locking element on an upper side thereof comprises a grip element which may be gripped with fingers and by way of which the locking element may be moved.

7. A waste water lifting installation according claim 1, wherein the locking element comprises a first engagement element which may be brought into engagement with a corresponding second engagement element.

8. A waste water lifting installation according to claim 7, wherein the second engagement element is formed on an insert which is connected to the collection container or the flange plate.

9. A waste water lifting installation according to claim 7, wherein:

the first engagement element is an engagement projection and the second engagement element comprises a recess or an undercut; and the engagement projection may be brought into engagement with the recess or an undercut.

10. A waste water lifting installation according to claim 7, wherein the first and the second engagement element comprises corresponding threads which may be brought to mesh with one another.

11. A waste water lifting installation according to claim 7, wherein:

the first engagement element is a pivotable lever and the second engagement element is a locking projection which is formed on the flange plate; and, in a locking position, the lever engages over the locking projection on an upper side.

12. A waste water lifting installation according to claim 11, wherein the lever is pivotable about a horizontally extending pivot axis.

13. A waste water lifting installation according to claim 11, wherein the lever is releasably fixed in the locking position with a non-positive fit and/or positive fit.

14. A waste water lifting installation according to claim 11, wherein the lever is curved in a manner such that in the locking position, the lever bears on a curved outer surface of a run-in of the collection container.

15. A waste water lifting installation according claim 1, further comprising a housing part wherein the flange plate and components arranged thereon are covered by the housing part, wherein the locking element and the housing part are formed corresponding to one another in a manner such that when the locking element is located in a released position, the housing part may not be attached to the flange plate.

16. A waste water lifting installation comprising:

a collection container with an opening on an upper side of the collection container;

a flange plate which closes the opening of the collection container;

a pump assembly fastened on the flange plate; and a single locking element releasably fixing the flange plate on the collection container at a first side edge, said first side edge facing a middle region of the waste water lifting installation, said locking element being rotatable, about a rotatable axis, between a locking position and a release position, said locking position being located at a circumferentially spaced location from said release position with respect to said rotatable axis, said release position being less than 360° away from said locking position, wherein said locking element rotates about an angle less than 360° between said release position and said locking position.

17. A waste water lifting installation according claim 16, wherein the locking element comprises a first engagement element which may be brought into engagement with a corresponding second engagement element.

18. A waste water lifting installation according to claim 17, wherein:

the first engagement element is a pivotable lever and the second engagement element is a locking projection which is formed on the flange plate; and, in a locking position, the lever engages over the locking projection on an upper side.

19. A waste water lifting installation according to claim 18, wherein the lever is curved in a manner such that in the locking position, the lever bears on a curved outer surface of a run-in of the collection container.

20. A waste water lifting installation comprising:

a collection container with an opening on an upper side of the collection container;

a flange plate which closes the opening of the collection container;

a pump assembly fastened on the flange plate; and a single locking element releasably fixing the flange plate on the collection container at a first side edge, said first side edge facing a middle region of the waste water lifting installation, said locking element being mounted for movement such that said locking element rotates, about a rotatable axis, between a locking position and a release position, wherein said rotates about an angle of less than 360° between said locking position and said released position with respect to a circumferential direction about said rotatable axis, said single locking element and said collection container defining a single connection point of said flange plate to said collection container at said first side edge with said single locking element in said locking position.

* * * * *